US005182606A

United States Patent [19]

Yamamoto et al.

[11] Patent Number: 5,182,606

[45] Date of Patent: Jan. 26, 1993

[54] IMAGE FIXING APPARATUS

[75] Inventors: Akira Yamamoto, Tokyo; Shigeo Kimura, Yokohama; Kensaku Kusaka, Kawasaki; Hidekazu Maruta, Hachiohji; Hiroyuki Adachi, Tokyo, all of Japan

[73] Assignee: Canon Kabushiki Kaisha, Tokyo, Japan

[21] Appl. No.: 782,790

[22] Filed: Oct. 5, 1991

Related U.S. Application Data

[63] Continuation of Ser. No. 542,068, Jun. 22, 1990, abandoned.

[30] Foreign Application Priority Data

Jun. 22, 1989 [JP] Japan ..... 1-161388

[51] Int. Cl.[5] ..... G03G 15/20

[52] U.S. Cl. ..... 355/289; 219/216

[58] Field of Search ..... 355/282, 285, 289, 290; 219/216, 469; 428/473.5, 421, 331, 323

[56] References Cited

U.S. PATENT DOCUMENTS

| | | | |
|---|---|---|---|
| 3,578,797 | 5/1971 | Hodges | 219/388 X |
| 3,810,735 | 5/1974 | Moser | 219/216 X |
| 3,811,828 | 5/1974 | Ohta et al. | 219/216 X |
| 3,941,911 | 3/1976 | Newton | 428/473.5 X |
| 4,470,688 | 9/1984 | Inagaki et al. | 355/290 X |
| 4,566,779 | 1/1986 | Coli et al. | 355/212 |
| 4,670,325 | 6/1987 | Bakos et al. | 428/209 |
| 4,739,363 | 4/1988 | Hoshika et al. | 355/274 |
| 4,780,742 | 10/1988 | Takahashi et al. | 355/290 |
| 4,910,068 | 3/1990 | Takagi et al. | 428/473.5 X |
| 4,954,845 | 9/1990 | Yano et al. | 355/290 |

OTHER PUBLICATIONS

Hirabayashi et al.; EPA #295,901; Dec. 21, 1988.

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image fixing apparatus includes a heater; a film movable with a recording material, in which the recording material has a visualized image which is heated through the film by heat from the heater; and the film has a heat resistive resin base layer containing inorganic electrically insulative filler material and a parting layer containing electrically conductive filler material.

12 Claims, 5 Drawing Sheets

IMAGE FIXING APPARATUS

This application is a continuation of application Ser. No. 542,068, filed June 22, 1990, now abandoned.

FIELD OF THE INVENTION AND RELATED ART

The present invention relates to an image fixing apparatus for heat-fixing an unfixed image through a film and a fixing apparatus for re-heating-fixing an image to improve the surface property of the image.

A heat-fixing apparatus for heat-fixing a visualized image is widely used with an image forming apparatus such as an electrophotographic apparatus. Since flash fixing apparatus or oven fixing apparatus are bulky, and the power consumption is large. Therefore, in a widely used conventional image fixing apparatus wherein the toner image is fixed on the recording medium supporting an unfixed toner image, the recording material is passed through a nip formed between a heating roller maintained at a predetermined temperature and a pressing or back-up roller having an elastic layer and press-contacted to the heating roller.

The heat roller type fixing apparatus requires that the surface temperature of the heating roller is controlled strictly at a predetermined temperature in order to prevent so-called high temperature off-set and low temperature off-set. This necessitates a large capacity of the heating roller.

Therefore, the image formation prevented period (waiting period) is long until the surface temperature of the heating roller reaches a set level.

As shown in U.S. Pat. No. 3,578,797, a belt type image fixing apparatus is known. In this system, (1) the toner image is contacted to a heater web and is heated to the fusing point temperature, and therefore, is fused; (2) the toner is cooled and solidified to have a high viscosity; and (3) the adherence of the toner is weakened, and then it is separated from the heater web. By doing so, the toner image is fixed without production of toner off-set. With this belt type fixing system, the tolerable range for the toner heating temperature is wide, and the waiting period can be reduced.

U.S. Pat. application Ser. Nos. 07/206,767, 07/387,970 now U.S. Pat. No. 4,954,845, Ser. Nos. 07/409,341, 07/416,539, 07/426,082, 07/435,247, 07/440,380, 07/440,678, 07/444,802, 07/446,449, 07/496,957, and 07/502,223 an image fixing apparatus having a fixed heater and a heat-resistive fixing film in a sliding contact with the heater, wherein the toner image is fused through the film.

With the fixing apparatus using the thin film, the electric power consumption is small, and the waiting period is significantly reduced or eliminated.

In the film fixing apparatus, however, the film is heated to a high temperature level for a long period of time with application of tension thereto, with the possible result of elongation due to the creep. In order to increase the thermal efficiency of the fixing, the film is desirably thin. In experiments carried out by the inventors, a high durability film was made of polyimide resin material having a thickness of 12 microns and a tension elasticity of 800 kgf/mm$^2$ was prepared, and it was coated with a PTFE (polytetrafluoroethylene resin) parting layer at a side contactable to the recording material. It was an endless fixing film having a circumferential length of 300 mm. The endless film was incorporated in an image fixing apparatus shown in FIG. 1 which will be described in detail thereafter. The film was continuously driven for 20 hours with the tension of 50 g/mm while the heater is energized at 200° C., the elongation of 0.6 mm was produced, and the film lateral shift control became not possible. In addition, fine cracks is produced in the PTFE coating, and the parting property was decreased.

When the thickness of the polyimide film was increased up to 60 microns in order to increase the strength of the film, the thermal conductivity of the film was approximately $4\times10^{-4}$ cal/cm.sec.° C., so that the image fixing performance was remarkably reduced under the same temperature condition.

SUMMARY OF THE INVENTION

Accordingly, it is a principal object of the present invention to provide an image fixing apparatus wherein the film is not elongated even if it is heated and driven continuously for a long period of time.

It is another object of the present invention to provide an image fixing apparatus wherein the heat transfer from the heater to the visualized image is good.

It is a further object of the present invention to provide an image fixing apparatus wherein the visualized image is heated through a film containing in organic filler material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 4:
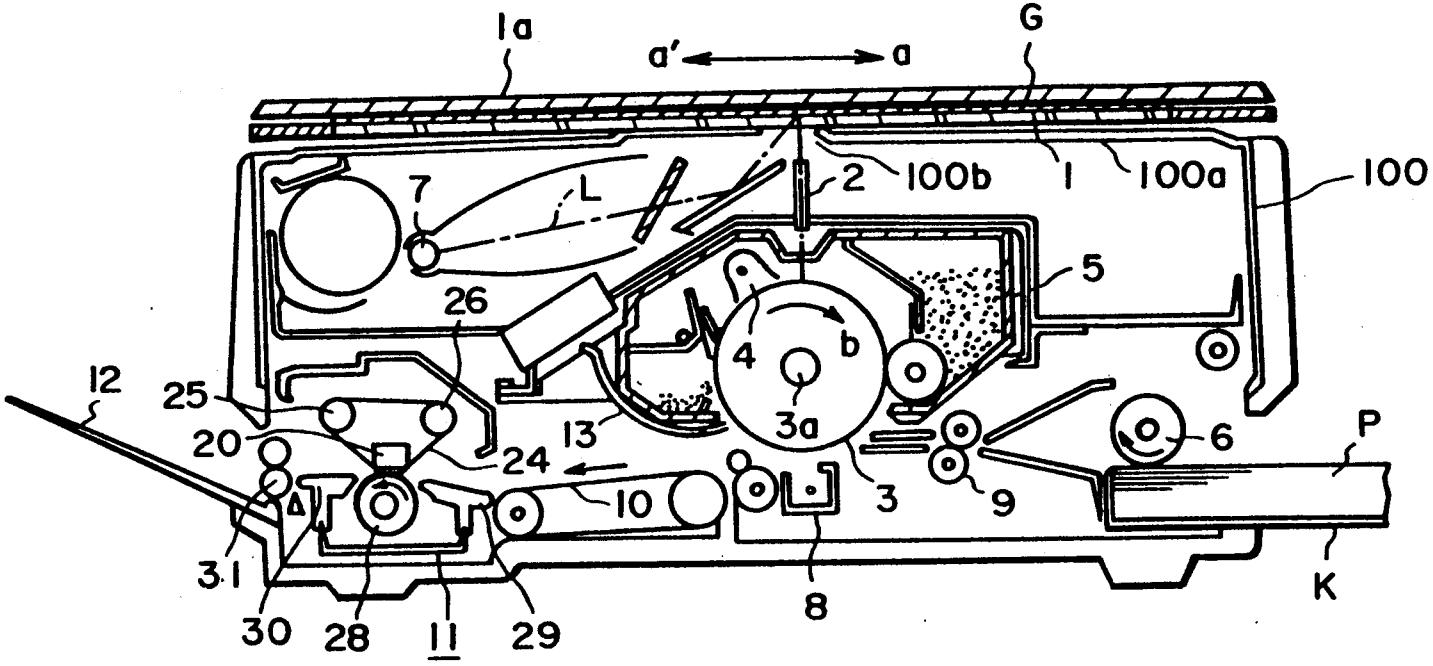
FIG. 4 is a sectional view of an image forming apparatus having the image fixing apparatus of FIG. 1.

Referring to the accompanying drawings, the embodiments of the present invention will be described Referring first to FIG. 4, there is shown an image forming apparatus of an electrophotographic copying machine using the fixing apparatus according to an embodiment of the present invention.

The apparatus comprises a housing 100, a reciprocable original supporting platen 1 made of transparent member such as glass plate disposed on the top plate 100*a* of the housing 100, wherein the original supporting platen 1 is reciprocable rightwardly (a) and leftwardly (a') on the top plate 100*a* at predetermined speeds.

An original G is placed face down on the original supporting platen 1 at a predetermined placing reference, and is covered by an original cover 1*a*.

A slit opening 100*b* is formed on the top plate 100*a* extending in a direction perpendicular to the reciprocable movement direction of the original supporting platen (perpendicular to the sheet of the drawing). The slit constitute a part of the original illuminating system. The face-down image surface of the original G placed on the original supporting platen 1 passes by the slid opening 100*b* during the movement of the original supporting platen 1 toward the right side (a). During the passage, the light L of the lamp 7 illuminates the original G through the slit opening 100*b* and the transparent original supporting platen 1. The light reflected by the original is imaged on the surface of the photosensitive drum 3 through an array 2 of imaging elements having a short focus and a small diameter.

The photosensitive drum 3 is coated with a photosensitive layer such as zinc oxide photosensitive layer or an organic photoconductor photosensitive layer. It is rotatable about a central axis 3*a* at a predetermined peripheral speed in the clockwise direction (b). During the rotation, the photosensitive drum 3 is uniformly charged to a positive or negative polarity by a charger 4, and the uniformly charged surface is exposed to the image light of the original through the slit opening, so that an electrostatic latent image corresponding to the light image is sequentially formed on the surface of the photosensitive drum 3.

The electrostatic latent image is visualized into a toner image with heat-softening or -fusing resin or the like (toner powder) by the developing device 5, and the visualized toner image is conveyed to the image transfer station having the transfer discharger 8.

The transfer material sheets P are contained in a cassette K. The sheet is singled out from the cassette by rotation of a pick-up roller 6 and is fed to the photosensitive drum 3 in such a timed relationship that when the leading of the toner image formed portion on the drum 3 reaches the transfer discharger 8, the leading edge of the transfer sheet P reaches the position between the transfer discharger 8 and the photosensitive drum 3. By the transfer discharger 8, the toner image is sequentially transferred onto the fed sheet from the photosensitive drum 3.

The sheet having received the toner image is sequentially separated from the surface of the photosensitive drum 3 by an unshown separating means and is introduced by conveying device 10 to an image fixing apparatus 11, where the unfixed toner image is heat-fixed. Thereafter, it is discharged onto the discharge tray outside the apparatus as a final print (copy) by a guide 30 and discharging rollers 31.

On the other hand, the surface of the photosensitive drum 3 having been subjected to the toner image transfer operation is cleaned by the cleaning device 13 so that the residual toner or other contamination are removed to be prepared for the next image forming operation.

Figure 1:
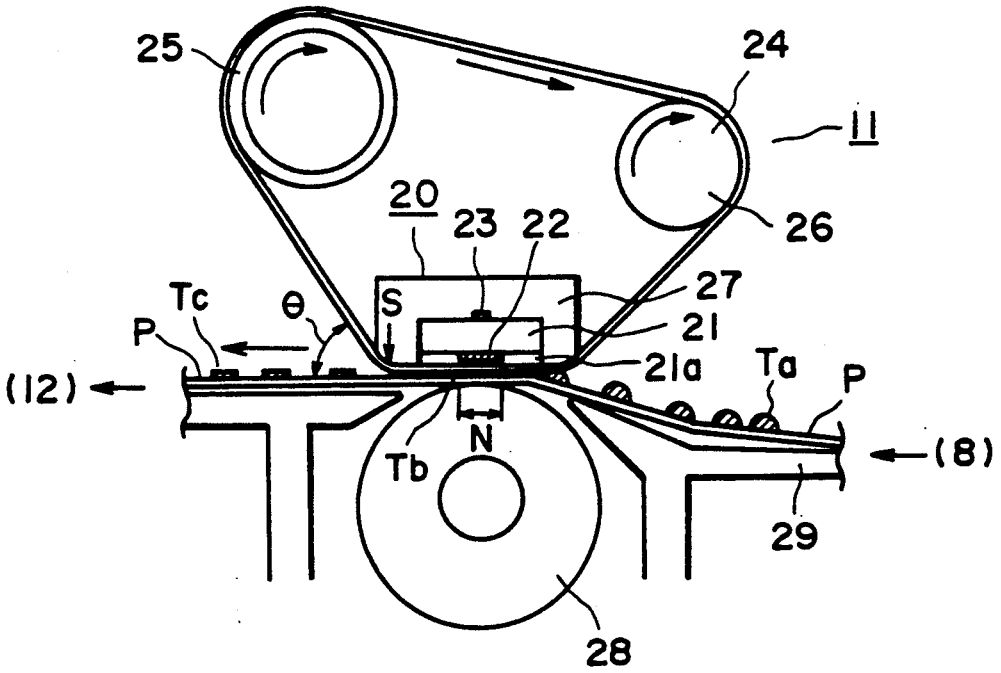
FIG. 1 is a sectional view of an image fixing apparatus according to an embodiment of the present invention.

Referring to FIG. 1, the description will be made as to the image fixing apparatus 11 in the image forming apparatus of FIG. 4. FIG. 1 is an enlarged sectional view of the image fixing apparatus.

An image fixing film 24 is in the form of an endless belt, and is stretched around parallel four members, i.e., a driving roller (left side) 25, a driven roller (right side) 26, a linear heater which has a low thermal capacity and which is disposed at a lower position between said driving roller 25 and the driven roller 26 and a heater supporting member 27.

The driven roller or follower roller 26 functions also as a tension roller for the endless fixing film 24. When the driving roller 25 rotates in the clockwise direction the fixing film 24 rotates also in the clockwise direction at a predetermined peripheral speed, that is, the same speed as the conveying speed of the transfer sheet P conveyed from the image transfer station 8 and carrying thereon an unfixed toner image Ta, without speed difference, without production of crease and without snaking motion.

Although not shown in the Figure, in order to prevent lateral shifting of the endless fixing film 24 in a long term use, film shift control means (not shown) is provided to change the tension to the fixing film 24 supported on the rollers 25 and 26 and the heater 20 at the longitudinal end or ends of the rollers 25 and 26, or means is provided to change a level or levels of the roller or rollers. Another means is usable for the same purpose.

In this embodiment, the film lateral shift control is effected by vertically shifting a longitudinal end of the follower roller 26 at the front side. When the end is raised, the film moves toward front, and when it is lowered, the film moves toward rear.

A pressing roller (pressing member) 28 has a rubber elastic layer made of rubber material having good parting property such as silicone rubber. It is urged, by unshown urging means, toward the bottom surface of the heater 20 with the total pressure of 4–7 Kg with the bottom travel of the fixing film 24 sandwiched therebetween. The pressing roller 28 rotates in the counterclockwise direction, that is, in the same peripheral movement direction as the transfer sheet P.

The heater 20 having the low thermal capacity and having the linear shape, in this embodiment, comprises the heater supporting member 27 extending in the direction of the width of the fixing film 24 (perpendicular to the movement direction of the fixing film 24). The supporting member has sufficient rigidity, heat-resistivity and heat-insulation properties. The heater 20 also comprises a heater base 21 mounted on the bottom surface of the supporting member 27 and extended along the length of the supporting member 27. The heater base is provided with a heat generating element 22 and a temperature detecting element 23.

The heater supporting member 27 having a low thermal conductivity functions to support the heater 20 on the fixing apparatus, and therefore, on the image forming apparatus with sufficient thermal insulation. Examples of usable materials for the heater supporting member 27 are high heat-resistivity resins such as PPS (polyphenylenesulfide), PAI (polyimide amide), PI (polyimide), PEEK (polyether ether ketone) or liquid crystal resins, or composites of such a resin and ceramic material, metal, glass or the like.

The heater base 21 having a high thermal conductivity has, for example, an alumina plate having a thickness of 1.0 mm, a width of 10 mm and a length of 240 mm. The heat generating element 22 is applied through a screen printing process or the like on the bottom surface of the base 21 along the length thereof. It is made of electric resistance material such as Ag/Pd (silver-palladium), for example, and has a thickness of approx. 10 microns and a width of 1–3 mm. The heat generating element 22 is coated with a heat-resistive glass 21*a* having a thickness of approx. 10 microns as a surface protection layer.

The temperature sensor 23 is, for example, a temperature detecting element applied through a screen printing process on the top surface opposite from the surface having the heat generating element 22 at the center thereof. It is made of Pt film or the like having a low thermal capacity. The temperature sensor 23 may be in the form of a thermister having a low thermal capacity contacted to the base 21.

In this embodiment, the linear or strap form heat generating member 22 is connected with electric power at the opposite longitudinal ends, so that the heat is generated over the entire length thereof. The power is AC 100 V in this example. In response to the output of the temperature sensor 23, the power supply to the heat generating member is controlled by changing a phase angle of the electric power supplied from an unshown power supply circuit.

The image fixing operation of the apparatus of this embodiment will be described.

Upon image formation start signal, the image forming apparatus starts to form an image. A visualized toner powder image is formed on the transfer sheet P, and the transfer sheet having the toner image Ta is conveyed from the transfer station 8 to the image fixing apparatus 11. It is introduced along the guide 29 into the nip N formed between the pressing roller 2 and the fixing film 24 urged by the pressing roller toward the heater 20, and is passed through the nip together with the fixing film in contact with the bottom surface of the film without relative movement therebetween and without production of crease.

The heater 20 is energized at predetermined timing from the image formation start signal, so that the toner image Ta is heated at the nip N and is fused into a fused image Tb.

The movement direction of the fixing film 24 abruptly changes by as large as approx. 45 degrees ($=\theta$) at an edge S of the supporting member which has a large curvature (radius of approx. 2 mm). The sheet P which comes through the nip N with the fixing film 24 in contact is separated by the abrupt increase of the curvature from the fixing film 24 at the edge S. It is conveyed to the discharge tray 12. By the time of the sheet P reaching the discharge tray 12, the toner is sufficiently cooled and solidified so as to be completely fixed on the sheet P into the fixed toner image Tc.

The toner used in this embodiment has sufficiently high viscosity when heated and fused to provide far higher adherence among toner particles that the adherence between the toner and the fixing film 24, even if the temperature of the toner at the time of the separation thereof from the fixing film 24 is higher than the melting point of the toner. For this reason, substantially no toner offset occurs to the fixing film 24 when the sheet is separated from the fixing film 24.

In this embodiment, the thermal capacities of the heat generating element 22 and the base 21 of the heater 20 are small, and are supported by the supporting member with the thermal insulation provided by the supporting member 27, so that the surface temperature of the heater 20 at the nip N rapidly raised to a level sufficiently higher than the toner fusing point (or the fixable temperature relative to the sheet P). Therefore, there is no need of stand-by heating to heat the heater beforehand. Accordingly, the energy consumption can be saved, and the temperature rise in the apparatus can be prevented.

Figure 2:
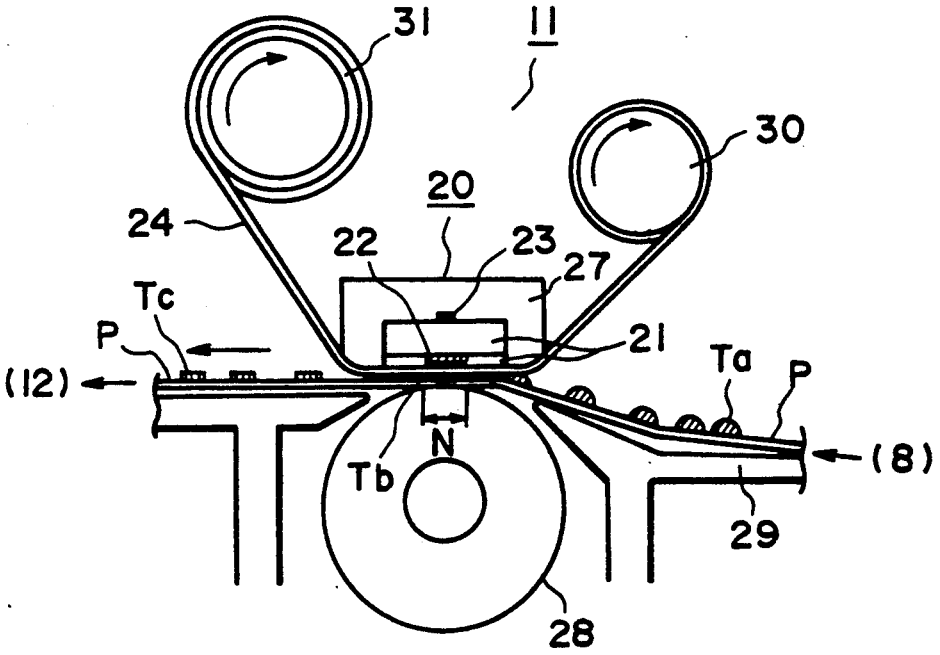
FIG. 2 shows an example of a non-endless film as the fixing film.

The fixing film 24 in not limited to an endless belt, but may be a non-endless belt wrapped on a supply shaft 30 and on a take-up shaft 31 through the nip formed between the heater 20 and the pressing roller 28, as shown in FIG. 2. The film 24 in this form is moved from the supply shaft 30 side to the take-up shaft 31 side at the same speed as the transfer material conveying speed.

The description will be made as to the fixing film 24 used in this embodiment. The film 24 has a heat resistive resin base layer containing 0.1–30%, preferably 1–30% of inorganic filler. By doing so, the tensile strength of the film during the heating is increased, and in addition, the thermal conductivity is increased, by which the image fixing efficiency is also increased. Therefore, sufficient image fixing property can be provided even if the control temperature of the heater is decreased.

In addition, the mixture of the filler material provides fine concave and convex portions on the film surface, or the parting layer is added to the film surface, so that the frictional resistance between the film and the heater or the driving roller is decreased, and therefore, the film lateral shift control can be smoothly performed.

Figure 3A:
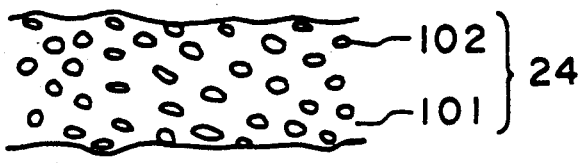
FIGS. 3A, 3B and 3C are sectional views of the film illustrating the laminated structure thereof
Figure 3B:
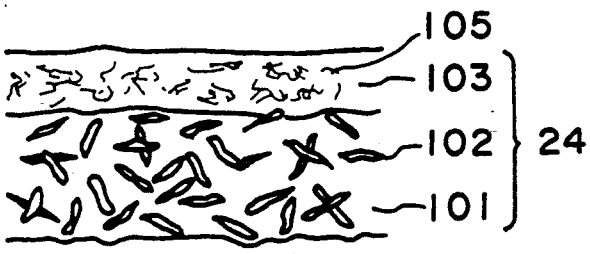
Figure 3C:
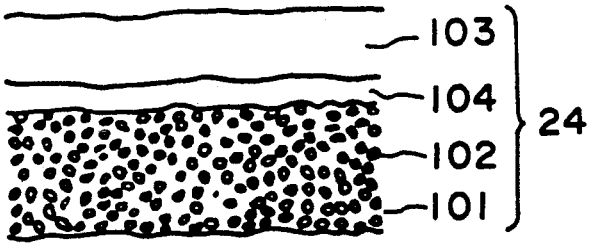

FIGS. 3A, 3B and 3C schematically show the layer structures of the films according to the present invention.

In FIG. 3A, the film comprises heat resistive resin material 101 and inorganic filler material 102. The film 24 of this structure can be produced by dispersing the inorganic filler such as carbon in the heat resistive resin material such as polyimide precursor liquid, and applying the liquid to a mold, heating it into imide. Thereafter, it is separated from the mold.

FIG. 3B shows a film comprising a heat resistive resin material 101 and needle like inorganic filler material 102 (SiC whisker, for example), and a parting layer 103 at a side contactable to the recording material. The parting layer 103 is made of PFA resin, for example.

FIG. 3C shows an example of a film comprising a heat resistive resin material 101 and inorganic filler material 102 (silica, for example). The surface thereof contactable to the recording member is coated with a parting layer 103 (PTFE resin, for example) with a primer 104 therebetween.

The total thickness of the fixing film 24 is preferably not more than 100 microns, and further preferably not more than 50 microns. From the standpoint of the stabilized driving, it is preferably not less than 10 microns. The material thereof may be polyether ether ketone (PEEK), polyether sulfone (PES), polyether imide (PEI) or another heat resistive resins.

From the standpoint of the strength of the film, the polyimide resin is preferable.

The parting layer 103 is not necessary when the toner or the resin on the recording material is separated from the film after it is cooled sufficiently. However, the provision of the high parting layer of heat resistivity made of fluorinated resin material or silicone resin material such as PTFE, PFA or FEP is preferable.

The inorganic filler material dispersed in the heat resistive resin such as polyimide may be particles or whiskers of the heat resistive inorganic material such as carbon, silica or metal. However, if the filler material is not matched with the heat resistive resin which is the base material of the film, the strength may be reduced. In consideration of this, one ordinary skilled in the art can properly select the material, and/or may subject the filler material to the surface treatment, as desired.

If the content of this inorganic filler 102 is too small, the effect thereof is not sufficient, and if the content thereof is not less than 30% by weight, the strength of the base film material remarkably decreases. In consideration of these, it is 0.1–30%, further preferably 1–30% by weight.

In order to improve the thermal efficiency, it is preferable that the inorganic filler material 102 has a thermal conductivity not less than $2.0\times10^{-3}$ cal/cm.sec.° C.

Where the inorganic filler material 102 is in the form of conductive needles, the electric charge is concentrated on the needle-like filler materials 102 (FIG. 3B), so that the electric discharging effect of the film is enhanced, by which the charging of the film 24 can be suppressed. In this case, the volume resistivity of the inorganic filler material is preferably not more than $10^7$ ohm.cm.

If there is a pin hole or holes in the surface protection layer 21*a* of the heat generating element of the heater 20, the electric current is leaked from the heat generating resistor through the pin holes, with the possible result of adverse influence. Therefore, when there are pin holes in the protection layer 21*a*, the inorganic filler material 102 is preferably insulative, and the volume resistivity of the inorganic filler is preferably not less than $10^{14}$ ohm.cm.

The laminated structure of the heat resistive layer 101 and the parting layer 103 can be provided by bonding the parting layer, by coating the heat resistive layer with the parting layer material by electrostatic painting (coating), evaporation, CVD or another film formation process, or by simultaneous extrusion of the heat resistive material and the parting layer material.

The surface resistance of the fixing film 24 may be decreased by adding conductive material such as carbon black, graphite or conductive whisker 105 in the parting layer 103 as shown in FIG. 3B. By doing so, the electric charging of the toner contactable surface of the fixing film 24 can be prevented. When the toner contactable surface of the fixing film 24 is electrically insulative, the surface of the fixing film is charged with the possible result of the disturbance to the toner image on the sheet P (recording material) or the transfer of the toner image onto the fixing film 24 (so-called charge off-set). However, these problems can be avoided by the conductive material.

Figure 5:
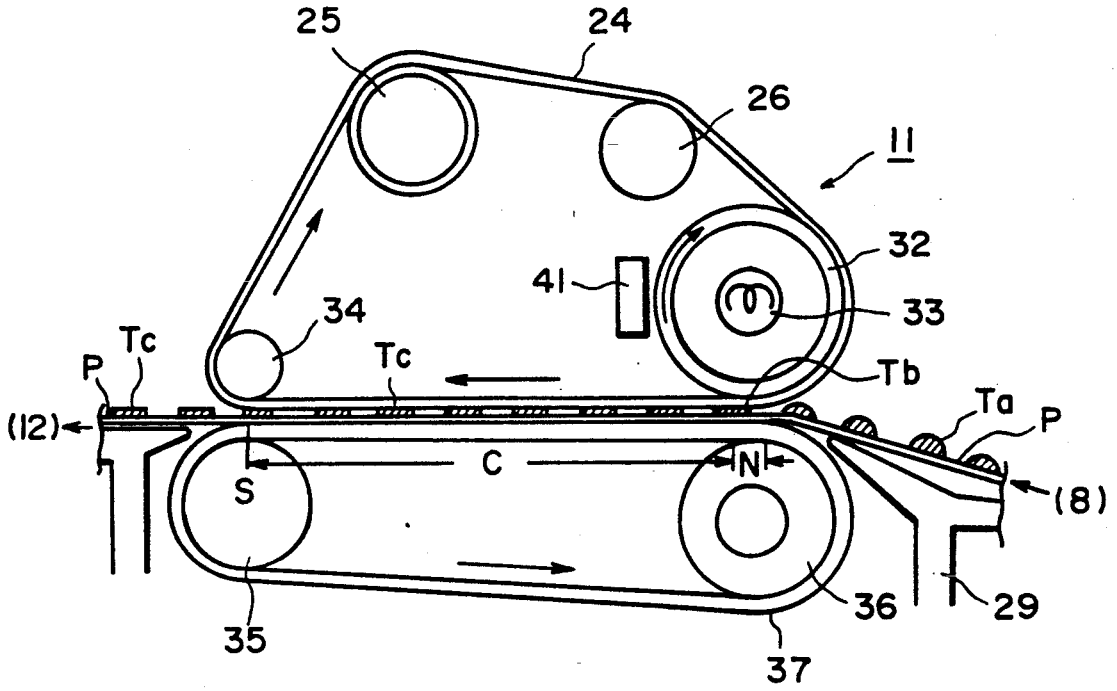
FIGS. 5, 6 and 7 are sectional views of the image fixing apparatuses according to further embodiments.

FIG. 5 shows an image fixing apparatus 11 according to another embodiment.

Designated by a reference numeral 32 is a heating roller (heating member) and contains a heater 33 which is energized in accordance with the surface temperature of the heating roller detected by a temperature sensor 41, so that the surface temperature of the heating roller 32 is maintained at a predetermined temperature level.

The fixing apparatus comprises an upper separation roller 34 having a small diameter and disposed downstream of the a heating roller 32 with respect to the conveyance direction of the sheet P, a driving roller 25 for rotationally traveling the fixing film, and a follower or driven roller 26 for applying proper tension at all times to the fixing film. The driving roller 25 and the driven roller 26 are rotated in the clockwise direction at the same speed as the sheet conveyance speed.

An image fixing film 24 is stretched around four parallel members 32, 34, 25 and 26.

The apparatus further comprises a pressing roller 36 disposed below the heating roller 32, a lower separation roller 35 disposed below a the upper roller 34, a conveyer belt (back-up belt) 37 in the form of an endless belt stretched around the pressing roller 36 and the lower separation roller 35. The pressing roller 36 has a surface layer made of elastic material such as silicone rubber. Between the pressing roller 36 and the heating roller 32, the bottom travel of the endless fixing film 24 is sandwiched, and the total pressure of 4–7 kg is applied by an unshown urging means.

When the heating roller 32 is rotationally driven, the pressing roller 36 rotates, by which the conveyer belt 37 rotates in the counterclockwise direction at the same speed as the sheet conveyance speed, while press-contacting the sheet P to the fixing film 34.

In operation, upon image formation start signal, the image forming apparatus starts to form an image. A visualized unfixed toner image is formed on the transfer sheet P, and thereafter the transfer sheet having the toner image Ta is conveyed from the transfer station 8 to the image fixing apparatus 11. It is introduced along the guide 29, while the fixing film 24 and the conveyer belt 37 are rotated, into the nip N formed between the pressing roller 28 and the fixing film 24 urged by the pressing roller toward the heating roller 32, and is passed through the nip together with the fixing film in contact with the bottom surface of the film without relative movement therebetween and without production of crease.

During the passage through the nip N, the toner image Ta is heated and is fused into a fused image Tb.

The portion of the sheet having passed through the nip N between the pressing roller 36 and the heating roller 32, continues to be conveyed in close contact in section c with the fixing film stretched between the heating roller 32 and the upper separation roller 34, before the portion reaches to the upper separation roller 34. The conveyer belt 37 supports the backside of the sheet P to maintain the close-contactness between the sheet P and the fixing film 24. During the conveyance process, the sheet of the soften/fused toner image Tb is radiated, by which a cooled/solidified toner image Tc is produced. The heat radiation in this radiation and cooling process is provided by the spontaneous radiation in this embodiment. However, a forced cooling may be employed with the use of a heat radiation fins or with the use of a fan.

When the portion reaches the upper separation roller 34, the fixing film 24 at point S is deflected along the upper separation roller 34 having a large curvature away from the sheet P surface, by which the fixing film 24 and the sheet P are separated from each other. Then, the sheet P is conveyed to the discharging tray 12. By the time of the separation, the toner is sufficiently cooled and solidified, so that the adherence of the toner to the sheet P is sufficiently large, whereas the adherence to the fixing film 24 is very small, so that the separation between the fixing film 24 and the sheet P is performed substantially without toner offset to the fixing film 24.

According to this embodiment, the set temperature of the heater may be increased than in the conventional heating roller type fixing system. By the increase of the temperature, the fixing performance is enhanced. In addition, the tolerable temperature range of the heater is larger at the high temperature side, so that the temperature control system is easy.

In addition, when the toner images of different, particularly three or more different color toners are fixed together (color mixture), the toner can be fused at the high temperature, and therefore, the color mixture is good. In addition, since the toner is once fused, and the fused toner is cooled and solidified while being in contact with the fixing film, and thereafter, it is separated from the fixing film, then the surface of the toner image follows the surface property of the fixing film. Therefore, if the fixing film is given the smooth surface, the surface of the toner image Tc can be as glossy as a silver salt photograph.

By reducing the thickness of the fixing film 24, the heat accumulation in the fixing film can be prevented, by which the cooling efficiency of the toner image is improved. Where the fixing film is made of thin resin, the contactness with the toner image is improved, so that the heat transfer efficiency is further improved.

Figure 6:
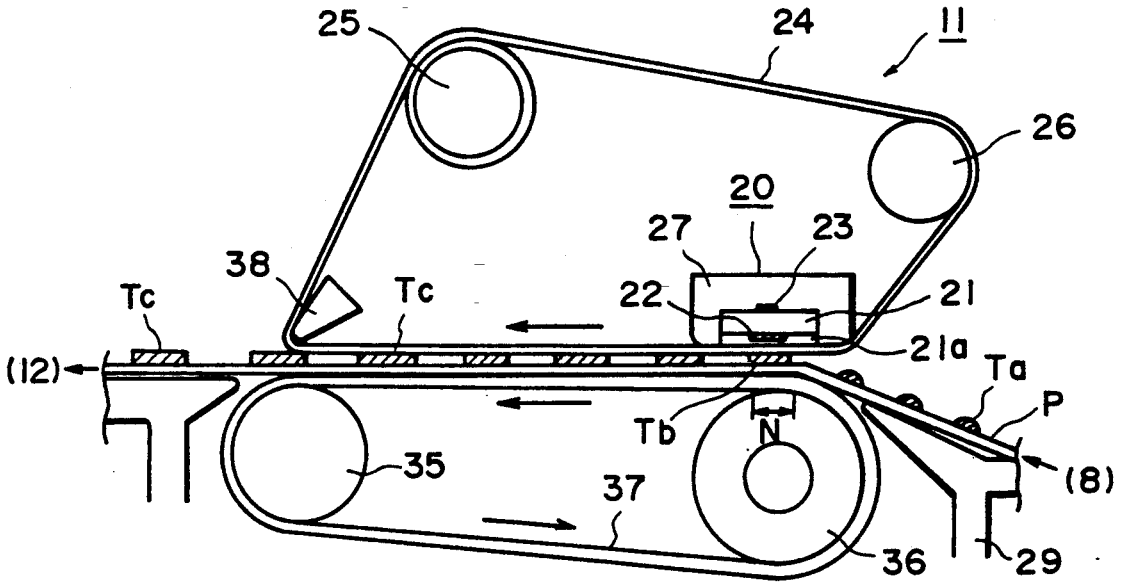

FIG. 6 illustrates a further embodiment.

The heater 32 is not limited to the form of the heating roller, but may be a fixed heater 20 of the first embodiment, as shown in FIG. 6. In this case, in addition to the above-described advantageous effects, the thermal capacities of the heat generating element 22 and the base plate 21 are small, and are thermally isolated, by which the temperature rising speed is high with the advantage of the elimination of the necessity of the stand-by temperature control.

In place of the upper separation roller 34, a separation stay 38 having a further large curvature edge may be disposed, by which the sheet P can be separated from the fixing film 24 with increased certainty.

Figure 7:
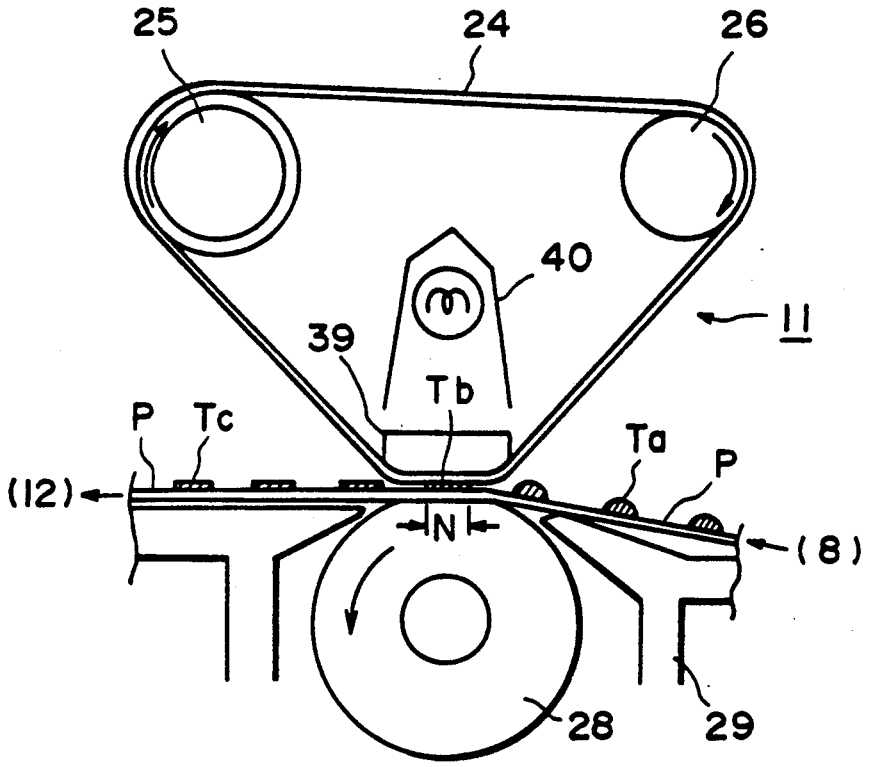

FIG. 7 shows an image fixing apparatus according to a yet further embodiment of the present invention.

FIG. 7 shows a yet further embodiment'

In place of the heater 20 of the first embodiment (FIG. 1), a transparent member 39 made of heat resistive glass or the like is disposed, through which the toner image is heated by a heat radiation source 40 such as halogen lamp disposed inside the endless fixing film 24.

In this embodiment, the fixing film 24 is preferably made of a material transparent to the wavelength of the radiation. Then, in this embodiment, the film 24 comprises, for example, heat-resistive layers 101 and 102 of polyimide resin containing the inorganic filler material (FIG. 3B) and a parting layer 103 made of transparent silicone resin.

From the standpoint of the energy transmission efficiency to the toner, the heater 20 which is instantaneously heated by the power supply thereto is preferable.

Examples of the fixing film will be described.

EXAMPLE 1

The base material of the heat resistive film 101 was polyimide resin, and the inorganic filler 102 of carbon was added. The content of the carbon was 3%. The structure was as shown in FIG. 3A, it was an endless film having a thickness of 45 microns, a circumferential length of 300 mm and a width of 250 mm.

The endless film was incorporated in the apparatus of FIG. 5 as the fixing film 24. It was driven with the heater temperature of 190° C., the tension of the film of 12.0 kg and the film driving speed of 60 mm/sec. After 30,000 copies were produced, the elongation of the circumferential length of the film 24 was as small as 0.45 mm. The lateral shift control by the lateral shift controller (not shown) was smooth without production of the crease in the film, and the film driving was stable.

EXAMPLE 2

The base material of the heat resistive film 101 was polyimide resin, and the inorganic filler material 102 was SiC whisker. The content of the whisker was 5%. The film was a laminated endless film as shown in FIG. 3B. It comprised the heat resistive film having a thickness of 45 microns and a PFA resin coating layer having a thickness of 15 microns as the parting layer 103 at a side contactable to the recording material.

The endless film was incorporated in the apparatus of FIG. 1 as the fixing film 24. It was driven with the temperature of 185° C. the tension to the film of 12.0 kg and the film driving speed of 60 mm/sec. After 30,000 copies were produced, the elongation of the circumferential length of the film was as small as 0.28 mm. The lateral shift control of the film was smoothly performed without production of the crease in the film. The driving of the film was stable.

EXAMPLE 3

The base material of the heat-resistive layer 101 was polyimide resin material. The inorganic filler material 102 was silica. The film 24 was as shown in FIG. 3C with a parting layer 103 of PTFE material through a primer layer 104 at a side contactable to the recording material.

The endless film was incorporated in the apparatus of FIG. 1 as the fixing film 24. It was driven under the same conditions as in the Example 2. After 30,000 copies were produced, the elongation of the film was 0.35 mm. The lateral shift control of the film was smooth without production of the crease in the film. The driving of the film was stable.

EXAMPLE 4

In order to confirm the effects of the filler material, samples 1–4 of the film were prepared, as shown in Table 1. Using the apparatus of FIG. 1, the temperature at which the image fixing operation is possible and the elongation of the film (%) were investigated after 30,000 copies were produced.

TABLE 1

| Samples | 1 | 2 | 3 | 4 |
|---|---|---|---|---|
| Film base material | polyimide | polyimide | polyimide | polyimide |
| Thickness of base (μm) | 40 | 40 | 40 | 40 |
| Filler | — | carbon | silicon carbide | silica |
| Filler content (%) | — | 3 | 5 | 1 |
| Coating (5 μm) | PFA | PFA | PFA | PTFE |
| Fixable temp. (°C.) | 200 | 190 | 185 | 190 |
| Film elongation (%) | 0.2 | 0.15 | 0.09 | 0.15 |

By mixing the inorganic filler material in the heat resistive resin of the film, the tensile strength (film elongation (%)) in the heated condition improved, as will be understood from the comparison between sample 1 and other samples (2–4). In addition, the thermal conductivity of the film is increased with the advantageous effect of the increased image fixing efficiency, so that the sufficient image fixing can be provided even if the set temperature of the heater (the fixable temperature) is lowered. Therefore, the life of the fixing film can be increased.

By mixing the filler material, the surface of the film becomes finely roughened or by the provision of the parting layer, the frictional resistance between the film and the heater or the driving roller is reduced, so that the lateral shift control of the film is made further smooth.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater having at least generating resistor for generating heat upon electric power supply and a protection layer for protecting said heat generating resistor; and a resin film movable with one surface in contact with said protection layer and the other surface in contact with a recording material having a visualized image, said film comprising a heat resistive resin base layer contactable to said protection layer and a parting layer thereon contactable to said recording material;

wherein said base and parting layer comprise filler materials, and the filler material in said base layer has a higher resistivity than the filler material in said parting layer.

2. An apparatus according to claim 1, wherein a content of the filler material in the base layer is 0.1–30% by weight.

3. An apparatus according to claim 2, wherein the content of the filler material in the base layer is 1–30% by weight.

4. An apparatus according to claim 1, wherein the filler material contained in the base layer has a thermal conductivity not less than $2.0\times10^{-3}$ cal/cm·sec·° C.

5. An apparatus according to claim 1, wherein said heater is stationary in use, and wherein the heat resistive resin base layer is in sliding contact with said heater.

6. An apparatus according to claim 5, wherein said heat generating resistor extends in a direction perpendicular to a movement direction of said film.

7. An apparatus according to claim 5, wherein there is no air layer between the heat generating resistor and the visualized image.

8. An apparatus according to claim 1, wherein the filler material in said base layer is electrically insulative, and the filler material in said parting layer is electrically conductive.

9. An apparatus according to claim 1, wherein the filler material in said base layer is inorganic material.

10. An apparatus according to claim 1, wherein said filler material in the base layer is in the form of whiskers.

11. An apparatus according to claim 1, wherein said filler material in the parting layer is in the form of whiskers.

12. An apparatus according to claim 1, wherein said heater has a protection layer on said heat generating resistor, and wherein said base layer is in contact with said protection layer.

* * * * *

UNITED STATES PATENT AND TRADEMARK OFFICE

CERTIFICATE OF CORRECTION

PATENT NO. : 5,182,606

DATED : January 26, 1993

INVENTOR(S) : AKIRA YAMAMOTO, ET AL.

It is certified that error appears in the above-indentified patent and that said Letters Patent is hereby corrected as shown below:

COLUMN 1

Line 49, "07/502,223" should read --07/502,223 propose--.

COLUMN 2

Line 26, "in" should read --an--.

COLUMN 5

Line 21, "roller" should read --roller 28--.

IN THE CLAIMS

COLUMN 11

Line 13, "at least" should read --a heat--.

Signed and Sealed this

First Day of March, 1994

Bruce Lehman

*Attest:*

BRUCE LEHMAN

*Attesting Officer*

*Commissioner of Patents and Trademarks*